US005585774A

United States Patent [19]

Bennett

[11] Patent Number: 5,585,774

[45] Date of Patent: Dec. 17, 1996

[54] CONDITION-RESPONSIVE ELECTRIC SWITCH MECHANISM

[75] Inventor: John M. Bennett, Fulton, Ill.

[73] Assignee: General Electric Company, Fort Wayne, Ind.

[21] Appl. No.: 299,454

[22] Filed: Sep. 1, 1994

[51] Int. Cl.[6] ..... H01H 37/54; H01H 37/12; H01H 37/18; H01H 5/20

[52] U.S. Cl. ..... 337/365; 337/368; 337/319; 337/347; 337/375; 200/407; 200/448

[58] Field of Search ..... 337/365, 368, 337/318, 319, 343, 345, 347, 375; 200/406, 407, 448, 461

[56] References Cited

U.S. PATENT DOCUMENTS

| | | | |
|---|---|---|---|
| 2,092,085 | 9/1937 | Riley | 200/83 |
| 2,447,894 | 8/1948 | Bauman | 62/4 |
| 2,447,895 | 8/1948 | Bauman | 62/2 |
| 2,533,671 | 12/1950 | Jacobs | 200/407 |
| 2,584,460 | 2/1952 | Jacobs | 200/407 |
| 2,596,704 | 5/1952 | Malutich | 200/140 |
| 2,598,563 | 5/1952 | Konle et al. | 200/140 |
| 2,637,794 | 5/1953 | Grotenhouse | 200/140 |
| 2,671,838 | 3/1954 | Senn | 200/140 |
| 2,701,475 | 2/1955 | Readeker | 200/406 |
| 2,755,362 | 7/1956 | Jacobs | 200/140 |
| 2,762,888 | 9/1956 | Jacobs | 200/140 |
| 2,806,927 | 9/1957 | Allen | 200/407 |
| 3,065,320 | 11/1962 | Cobean | 200/140 |
| 3,065,323 | 11/1962 | Grimshaw | 200/140 |
| 3,196,233 | 7/1965 | Burch | 200/407 |
| 3,648,214 | 3/1972 | Slonneger | 337/311 |
| 3,668,347 | 6/1972 | Korsgren | 200/407 |
| 3,735,069 | 5/1973 | Andresen | 200/67 D |
| 3,771,088 | 11/1973 | Sliger | 337/123 |
| 3,872,417 | 3/1975 | Hufschmid | 337/365 |
| 4,169,357 | 10/1979 | Kelley | 62/126 |
| 4,186,653 | 2/1980 | Hobbs | 92/34 |
| 4,224,488 | 9/1980 | Rossi | 200/67 A |
| 4,250,367 | 2/1981 | Rossi | 200/407 |
| 4,278,855 | 7/1981 | Rossi | 200/407 |
| 4,490,708 | 12/1984 | Thompson et al. | 337/320 |
| 4,510,480 | 4/1985 | Rossi et al. | 337/321 |
| 4,801,922 | 1/1989 | Worrell et al. | 340/586 |
| 4,937,549 | 6/1990 | Kelly et al. | 337/309 |
| 5,101,188 | 3/1992 | Kelly et al. | 337/309 |
| 5,142,261 | 8/1992 | Fuller et al. | 337/115 |

FOREIGN PATENT DOCUMENTS

| | | |
|---|---|---|
| 2121794 | 8/1972 | France . |
| 1558474 | 1/1980 | United Kingdom . |
| 2100519 | 12/1982 | United Kingdom . |
| 2111203 | 6/1983 | United Kingdom . |

OTHER PUBLICATIONS

Ranco Information Bulletin No. 1531010, "K™" Series Temperature Control, 1981.

Ranco Brochure, "K54 Cycling Control with Signal Switch", 1989.

Ranco Brochure, "K50 Fixed or Adjustable Cycling Thermostat", 1989.

*Primary Examiner*—Leo P. Picard
*Assistant Examiner*—Stephen T. Ryan
*Attorney, Agent, or Firm*—Ralph E. Krisher, Jr.

[57] ABSTRACT

A condition-responsive electric switch mechanism having a snap-acting bistable spring switch element carrying a movable contact, and an actuator movable in response to a detected condition to operate the bistable spring switch element. The spring switch element is capable of snapping between a circuit open position in which the movable contact is spaced from a fixed contact and a circuit closed position in which the movable contact engages the fixed contact. The spring switch element has a head mounting the movable contact thereon, and a pair of arms extending outwardly from the head being formed free of connection to one another at their distal ends opposite the head. The arms are fixed to a first terminal blade at their distal ends in a configuration deflected from the relaxed position so as to stress the switch element making it capable of snapping between the circuit open and circuit closed positions for a wide variety of preset contact gaps. The spring switch element is also capable of maintaining high contact force around the switch point.

31 Claims, 4 Drawing Sheets

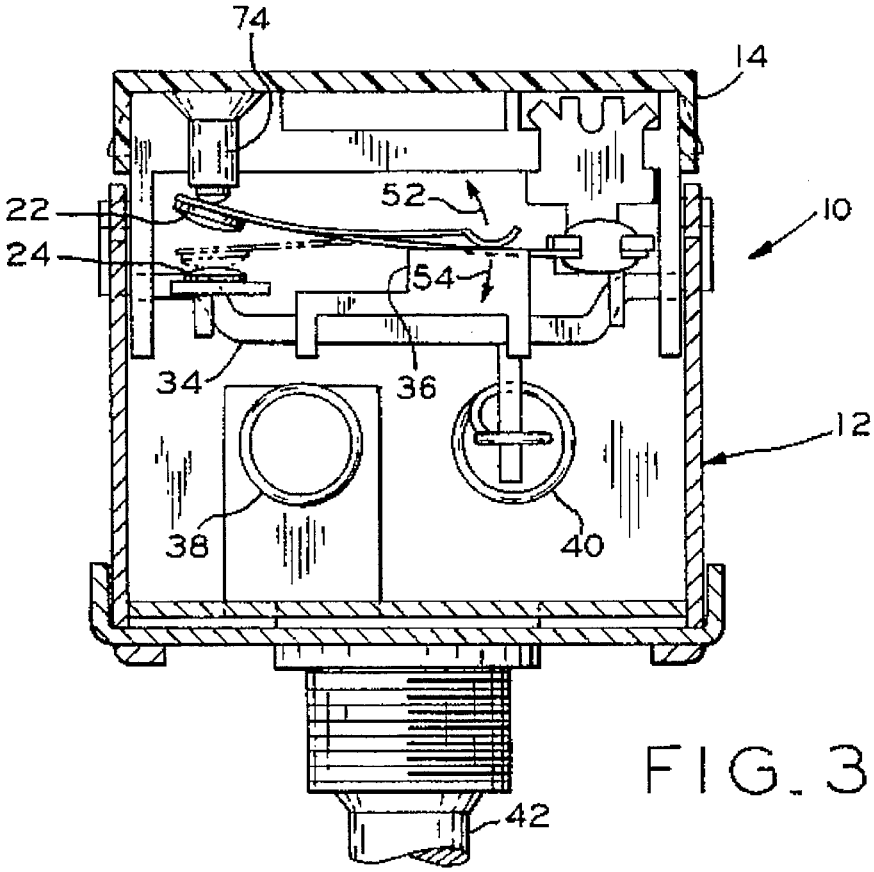
FIG. 3
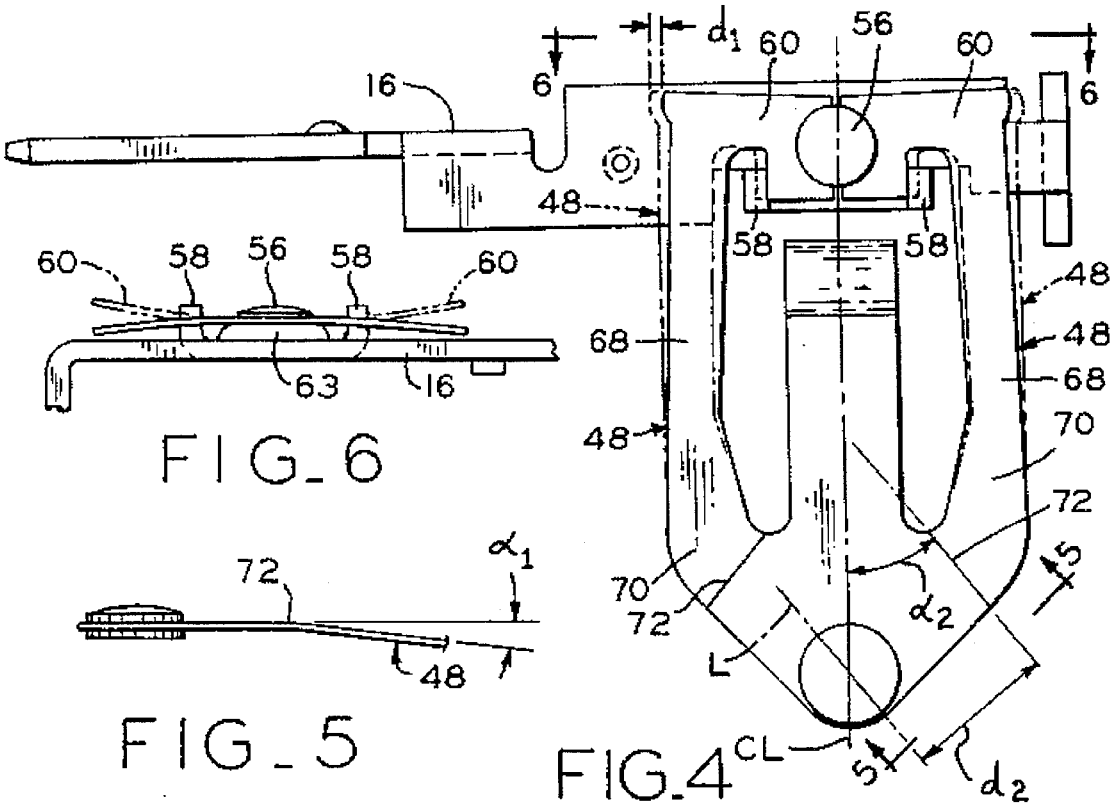
FIG. 6
FIG. 5
FIG. 4

CONDITION-RESPONSIVE ELECTRIC SWITCH MECHANISM

BACKGROUND OF THE INVENTION

This invention relates generally to condition-responsive controls and more particularly to a condition-responsive switch mechanism and a method for assembly of such a mechanism.

Switches that are responsive to temperature changes, commonly known as thermostats or cold controls, are used in refrigeration appliances, such a refrigerators and freezers, to control the temperatures therein. These thermostats regulate the switching cycle of the refrigeration compressor in response to the temperature of the air contained at some location within the appliance. When the temperature exceeds a certain "turn-on" point, the switch contacts are closed and the compressor is switched on to cool the appliance. When the temperature drops below a certain "turn-off" point, the switch contacts are opened and the compressor is switched off. Examples of thermostats for refrigeration appliances are set forth in U.S. Pat. No. 3,065,320 (Cobean), U.S. Pat. No. 3,065,323 (Grimshaw), U.S. Pat. No. 3,648,214 (Slonneger), U.S. Pat. No. 4,490,708 (Thompson et al.), and U.S. Pat. No. 5,142,261 (Fuller et al.). All of these patents are assigned to General Electric Company, the assignee of the present application, and their disclosures are expressly incorporated herein by reference.

Thermostats of the type to which this invention relates typically employ a bellows communicating with a capillary tube in thermal contact with the location to be cooled. Expansion and contraction of a gas within the capillary tube and bellows causes corresponding expansion and contraction of the length of the bellows. The motion of the bellows is transmitted via an actuator to a switch element such as a bistable spring switch element which is capable of snapping between two stable positions, one of which closes a circuit and activates the compressor to cool the appliance and the other of which opens the circuit to deactivate the compressor. The spring switch element is fixed to one circuit element and extends outwardly toward another circuit element and carries a electrical contact on its free end. In the circuit open position of the spring switch element, the spring switch element is spaced away from the other circuit element. In the circuit closed position, the contact on the spring switch element engages a contact fixed to the other circuit element and the circuit is completed. Snapping of the spring switch element is controlled by the actuator in the thermostat which presses against the spring switch element with a force increasing with the increase in temperature above the set point detected within the appliance. Eventually, the force reaches a switch point at which the spring switch element snaps from one position to another to open or close the circuit.

It has been found that as the actuator gradually approaches the switch point, the force with which the spring switch element urges its electrical contact against the fixed contact on the other circuit element is substantially reduced. In fact, the contact urging force goes substantially to zero as the actuator approaches the switch point. At low contact forces, the presence of particulate matter on either contact can cause a loss of electric connection. Vibrations in the appliance can also cause the connection to rapidly break and reconnect near the switch point, resulting in undesirable "chattering" of the compressor. These conditions may also lead to arcing between the contacts which can damage the contacts and change the operating characteristics of the thermostat.

It is desirable to have a single thermostat which is capable of operating different kinds of appliances without substantial modification. One important difference between different types of appliances is the need for the thermostat to have different sensitivities. For instance, one manufacturer may have a product for which a 10° F. variation in temperature from set point is desired, another may permit only a 5° F. variation and so on. One convenient way of achieving different sensitivities in the same thermostat is to vary the spacing between the fixed contact and the movable contact in the circuit open position. However, it has been found that the operability of each bistable spring switch element, having its own particular size and geometry, is very dependent upon contact spacing. Some spring switch elements will operate properly only when the contact gap is relatively wide (causing the thermostat to permit a relatively wide variation in temperature), others only when the gap is relatively narrow, and others only when the gap is somewhere in between. Thus, the applicability of any given thermostat to different appliances requiring different control sensitivities has heretofore been limited. Moreover in some applications, there is a demand for very silent operation of the appliance. Thus, any snapping or clicking noise which occurs as a switch element opens or closes is undesirable.

Mass production of thermostats is greatly facilitated by automation of assembly where possible. Presently, the capillary tubes are assembled with the bellows early in the process. The capillary tubes hang away from the thermostat, tend to become entangled in the machinery, and generally make automated handling difficult. In addition, the length of the capillary tube in the finished thermostat will be different depending upon the particular application and manufacturer who will use the switch. Typically, final sizing of the capillary tube occurs near the end of the assembly process by cutting the tube down to size, thereby wasting material. Calibration of the switch mechanism with the capillary tube attached is somewhat time consuming because the mass of refrigerant or air in the capillary tube slows down the reaction of the bellows to the calibrating stimulus.

The accuracy of the thermostat to turn on and off the compressor at the desired temperature settings for the appliance is dependent in part upon the purity of the refrigerant in the bellows and capillary tube. The more pure the refrigerant, the more closely its expansion and contraction in response to temperature behaves in an ideal, predictable fashion. Presently, thermostats are charged with vaporous refrigerant from the container in which the refrigerant is supplied to the factory. Air and other contaminants present in the vapor in various amounts can cause the thermostats to operate outside of specification for the refrigerant. Thus, the operating characteristics of one thermostat may be somewhat different than the next although both are manufactured identically.

Although the spring switch element of the present invention described hereinafter, is particularly adapted for use in a thermostat, it is also believed to be useful in other condition responsive switching devices such as one directly responsive to detected position or mechanical pressure.

SUMMARY OF THE INVENTION

Among the several objects and features of the present invention may be noted the provision of a condition-responsive electric switch mechanism which maintains a firm electrical contact as the mechanism approaches a point where switching between a circuit open configuration and circuit closed configuration occurs; the provision of such a switch mechanism which is quiet in operation; the provision of such a switch mechanism which permits substantial sensitivity adjustment of the mechanism by changing the gap between fixed and movable contacts; the provision of such a switch mechanism which has a long service life; and the provision of such a switch mechanism which is economical to manufacture and easy to assemble using automated assembly techniques.

Generally, a condition-responsive electric switch mechanism of the present invention comprises a housing including an insulating housing portion, and first and second terminal blades mounted on the insulating housing portion and projecting outwardly therefrom for connection in an electric circuit. The second terminal blade mounts a fixed contact. Condition-responsive means includes an actuator movable in response to a detected condition, and a bistable spring switch element carrying a movable contact. The spring switch element is adapted for snap-acting movement between a circuit open position in which the movable contact is spaced from the fixed contact and a circuit closed position in which the movable contact engages the fixed contact. The spring switch element comprises a head mounting the movable contact thereon and a pair of arms extending outwardly from the head and formed free of connection to one another at their distal ends opposite the head. The arms are fixed to the first terminal blade only along laterally inner edge margins of their distal ends in a configuration deflected from their relaxed positions thereby to stress the switch element for snapping between the circuit open and circuit closed positions. A toggle blade extending outwardly from the head from a location generally between the arms is operable by engagement with the actuator of the condition-responsive means for motion through a switch point at which the spring switch element snaps between the circuit open position and the circuit closed position.

Other objects and features will be in part apparent and in part pointed out hereinafter.

BRIEF DESCRIPTION OF THE DRAWINGS

FIG. 3 is a fragmentary section taken in the plane including line 3—3 of FIG. 1 with parts removed to show details;

FIG. 4 is an elevation of a spring switch element of the switch mechanism and showing a first terminal blade of the switch mechanism in phantom;

FIG. 5 is a fragmentary elevation of the spring switch element as seen from the vantage indicated by line 5—5 of FIG. 4;

FIG. 6 is a fragmentary end elevation of the spring switch element as seen from the vantage indicated by line 6—6 of FIG. 4;

Corresponding reference characters indicate corresponding parts throughout the several views of the drawings.

DETAILED DESCRIPTION OF THE PREFERRED EMBODIMENT

Figure 1:
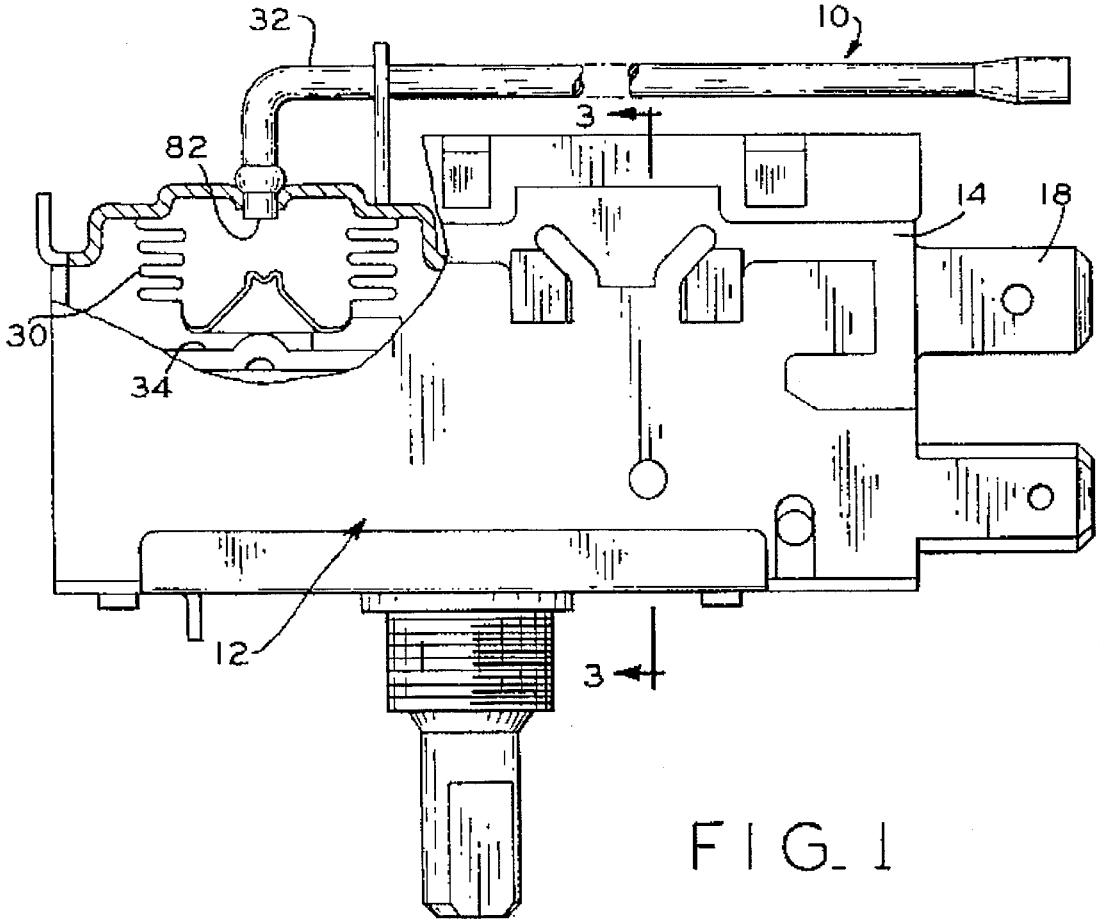
FIG. 1 is an elevation of a condition responsive electric switch mechanism with parts broken away to show internal construction.
Figure 2:
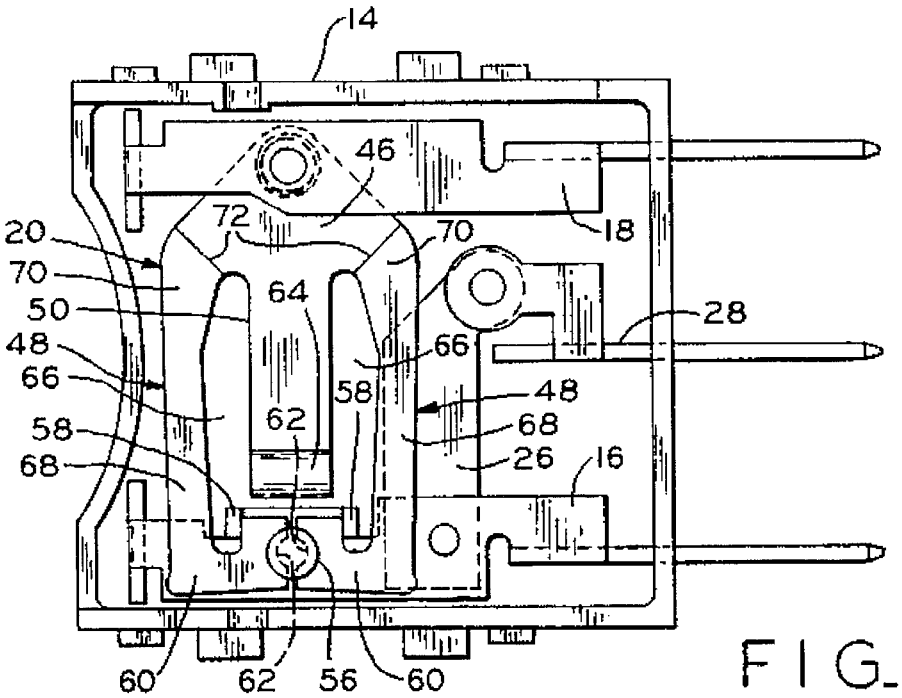
FIG. 2 is a bottom plan of an insulated housing portion of the switch mechanism.

Referring now to the drawings, and in particular to FIGS. 1–3, a preferred embodiment of the present invention is shown incorporated in a condition (e.g., temperature) responsive electric switch mechanism (generally indicated at 10), which is commonly referred to as a thermostat or cold control device. The switch mechanism has a housing, generally indicated at 12, including an insulated housing portion 14 mounting a first terminal blade 16 and a second terminal blade 18 each of which project outwardly from the housing for plug in connection to an electric circuit such as a power circuit for a compressor (not shown). The circuit is selectively opened and closed between the first and second terminal blades 16, 18 by actuation of a bistable spring switch element, indicated generally at 20, fixedly connected to the first terminal blade 16 and carrying a movable contact 22 selectively engageable with a fixed contact 24 on the second terminal blade 18. As shown in FIG. 2, a second switch element 26 extending between the first terminal blade 16 and a central terminal prong 28 is provided for disabling the switch mechanism (e.g., to turn off the refrigerator). Other switch features known to those of ordinary skill in the art and not directly pertinent to the scope of the present invention, may also be added.

Condition-responsive means for use in actuating the spring switch element 20 includes a bellows 30 within the housing 12 and a capillary tube 32 connected to the bellows and extending from the housing. The bellows 30 and capillary tube 32 are charged with an operating fluid (e.g., a refrigerant) which expands and contracts with the temperature of a location in thermal contact with the operating fluid in the capillary tube where temperature control is to be maintained, such as in a compartment of an appliance (not shown). The bellows 30 expands and contracts in an axial direction in correspondence with the expansion and contraction of the operating fluid within the bellows.

Movement of the bellows 30 is transmitted by an actuator link 34 to a switch actuator 36 engaging the spring switch element 20 (FIG. 3) for actuating the spring switch element between the circuit open and circuit closed positions. In the illustrated embodiment, the switch actuator 36 is an outwardly extending projection on the actuator link 34 on the opposite side of a pivot point (not shown) from where the link is engaged by the bellows 30. An adjustment mechanism of the switch mechanism 10 includes two springs (designated 38 and 40, respectively) mounted in the housing 12 and connected directly or indirectly to the actuator link 34. The springs 38, 40 are connected so as to urge the actuator link 34 to pivot in opposite directions. By adjustment of these springs 38, 40 the force necessary to move the switch actuator 36 can be made greater or lesser, thereby (in the context of a refrigerator or freezer appliance) adjusting the temperature set point. Adjustment of the set point can be made by a knob 42 extending out of the housing 12. Screws (not shown) are provided for making the initial tension settings of the springs 38, 40.

Referring now to FIGS. 2–6, the spring switch element 20 comprises a head 46 on which the movable contact 22 is mounted, a pair of arms (each designated generally at 48) extending outwardly from the head and a toggle blade 50 extending outwardly from the head from a location between the arms. Preferably, the head 46, arms 48 and toggle blade 50 are formed as one piece of a suitable electrically conductive material (e.g., beryllium copper). The spring switch element 20, as assembled in the switch mechanism 10, is adapted for snap-acting movement between two, convex and concave configurations, corresponding to the circuit open and circuit closed positions, respectively. As shown in FIG. 3, the toggle blade 50 is disposed within the housing 12 for engagement by and movement with the switch actuator 36. As illustrated in solid lines in FIG. 3, the spring switch element 20 is in the circuit open position with the toggle blade 50 approximately at the switch point where any further movement of the toggle blade in the direction indicated by arrow 52 will cause the switch element to snap into its circuit closed configuration (shown in phantom) in which the movable contact 22 engages the fixed contact 24 of the second terminal blade 18. From the circuit closed position, movement of the toggle blade 50 from the switch point in the direction indicated by arrow will cause the spring switch element 20 to snap back to the circuit closed position. In the present embodiment, increasing temperatures in the appliance cause the bellows 30 to expand and move the toggle blade 50 in the direction of arrow 52 and decreasing temperatures cause the bellows to contract moving the toggle blade in the direction of arrow 54.

In the preferred embodiment, the spring switch element 20 is not able to snap between the circuit open and circuit closed positions until assembled in the switch mechanism 10. As finally formed prior to assembly in the switch mechanism 10, the arms 48 are free of connection to each other at their distal ends opposite the head 46, and assume a relaxed position illustrated by phantom lines in FIG. 4. The arms 48 are deflected from their relaxed positions inwardly toward each other and secured in this configuration to the first terminal blade 16 by a single rivet 56. The deflection of the arms 48 produces a stress in the spring switch element 20 and causes it to assume a generally convex configuration. The spring switch element 20 is now capable of operating to snap between two (circuit open and circuit closed) positions. The spring switch element 20 will remain in the concave, circuit closed position only so long as a force greater than a certain amount is applied to the toggle blade 50.

In assembly of the switch mechanism 10, the deflection of the arms 48 is achieved by bending up two tabs 58 formed as part of the first terminal blade 16 (FIGS. 2 and 6). The tabs 58 each engage a respective arm 48 and deflect that arm inward a predetermined amount. The bend of the tabs 58 is controlled so that the desired amount of deflection of the arms 48 from their relaxed positions has occurred when the tabs reach their final positions. The arms 48 have finger portions 60 at their distal ends which project inwardly toward each other. Generally, semicircular cutouts 62 (FIG. 2) on the laterally inner edges of the finger portions 60 receive opposite portions of the rivet 56 used to fixedly secure the arms 48 in their deflected configuration. The rivet 56 secures the arms 48 to the first terminal blade 16 by engagement only with the laterally inner edge margins of the finger portions 60. Thus, the laterally outer edge margins of the finger portions 60 and distal ends of the arms 48 are free to flex as shown in phantom in FIG. 6 when the spring switch element 20 is in its circuit closed position. The distal ends of the arms 48 rest upon a raised platform 63 above the first terminal blade 16 to space the arms from the first terminal blade to permit this flexing.

The toggle blade 50 of the spring switch element 20 lies generally in the plane of the head 46 except at its distal end which is formed with a bump 64 for engagement by the actuator 36. The toggle blade 50 is preferably made as long as possible within the confines of the overall switch mechanism 10 dimensions and is constructed and arranged in the switch mechanism for engagement by the switch actuator 36 as near to its distal end as possible. There are two slots (each designated 66) in the spring switch element 20 on either side of the toggle blade 50 which are defined in part between each arm 48 and the adjacent edge of the toggle blade. The slots 66 taper inwardly at their longitudinal end portions nearest the head 46. The arms 48 each have a substantially constant width portion 68 extending from the finger portion 60 toward the head 46 along the corresponding slot 66 to the location where the slot beings to taper inwardly. From that point to its intersection with the head 46, each arm 48 has a portion 70 increasing in width. The vertex of the curved spring switch element 20 when it is in its closed circuit configuration is located generally at the junction of the constant width portion 68 and increasing width portion 70 of each arm 48. The vertex is that location where the slope of the spring switch element 20 changes between positive and negative.

The arms 48 and head 46 of the switch are preferably stamped from a blank and initially lie in substantially the same plane. However, the arms 48 are then permanently deformed along respective bend lines 72 out of the plane of the head 46 and toward each other so that the spring switch element 20 assumes a slightly convex configuration. As shown in FIG. 5, the arms 48 are bent out of the plane of the head 46 most preferably an angle $\alpha_1$ of between 3.5° and 4.5°. It is desirable to maintain the bend angle at between 3° and 6°, although it is to be understood that the angle of bend$\alpha_1$ could fall outside this range and still fall within the scope of this invention. The bend is preferably formed by wipe forming in which the edge margin of the die (not shown) around which the bend is formed lies on a radius, and the punch (not shown) is spaced outwardly a significant distance from the forming edge margin of the die as it strikes the spring switch element 20. Each of the bend lines 72 is oblique to the longitudinal centerline CL of the spring switch element 20 and passes generally through the longitudinal end of the corresponding slot 66 adjacent the head 46 (FIG. 4). Preferably, the angle$\alpha_2$ each bend line 72 makes with the longitudinal centerline CL is between 30° and 60°, and most preferably between 39° and 41°. However, it is understood that the bend lines 72 may make angles$\alpha_2$ with the centerline CL outside the preferred and most preferred ranges and still fall within the scope of the present invention.

In one specific example of the switch mechanism 10 of the present invention, the spring switch element 20 has an overall length of 0.899 inches (all dimensions being nominal), a width (measured across the arms) of 0.512 inches, and a thickness of 0.007 inches. In length, the arms 48 are 0.622 inches and the increasing width portion of the arms 0.168 inches or about 27% of the total length of the each arm. The length of the arms is measured between lines perpendicular to the longitudinal axis of the switch element, one at the distal end of the arms and the other intersecting the longitudinal ends of the slots at the head 46. However, the boundary of the arms 48 at the head end of the switch element is generally considered to be the bend line 72 for purposes of the discussion herein. The finger portions 60 of the arms are separated at their closest approach to each other prior to the permanent bend in the switch element by 0.042 inches. The toggle blade 50 is 0.445 inches long and 0.158 inches wide, and the slots 66 are 0.545 inches long. The bend lines 72 are each located a distance from a parallel line L passing through the center of the movable contact 22 of between about 0.196 and 0.236 inches, and more preferably between about 0.211 and 0.221 inches. In this example, the arms 48 are pulled in toward each other from their initial condition coplanar with the head 46 a total distance of 0.028 inches (measured traversely across the spring switch element 20 at the distal ends of the arms). The arms 48 are pulled in about 0.004 inches through the formation of the permanent bends, the remainder (0.024 inches) occurs in the elastic deflection of the arms from their relaxed positions as installed in the switch mechanism. As shown in FIG. 4, each arm 48 is deflected a distance $d_2$ of about 0.012 inches from its relaxed position upon installation in the switch mechanism 10. It is to be understood that the foregoing is only an example and that the dimensions of the switch mechanism 10 and the distance the arms 48 are deflected may vary from those described above and still fall within the scope of the present invention.

Figure 7A:
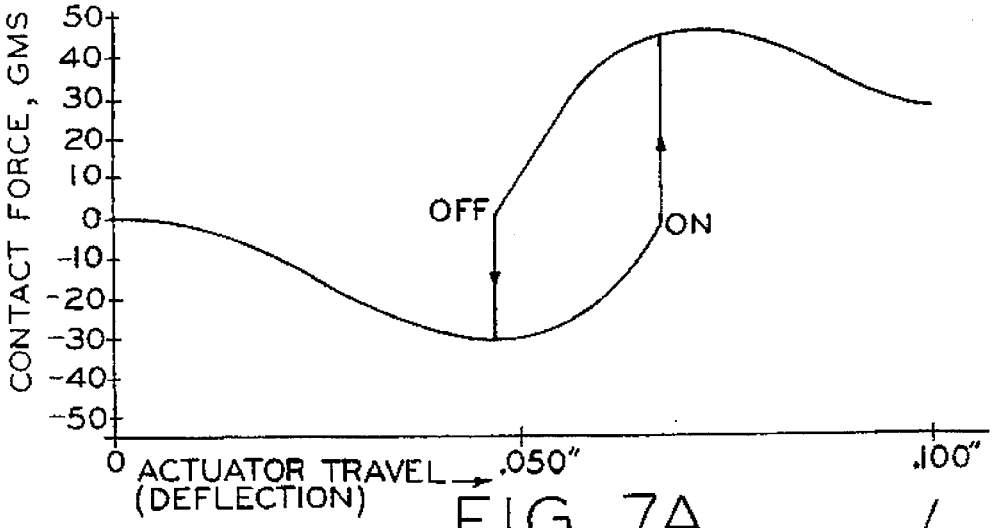
FIG. 7A is a graph of contact force versus actuator travel for a prior art switch mechanism.
Figure 7B:
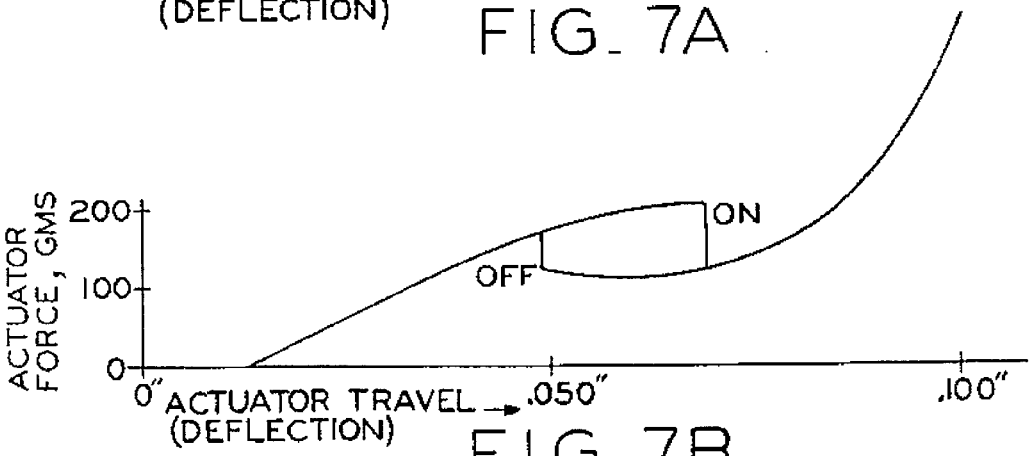
FIG. 7B is a graph of actuator force versus actuator travel for the prior art switch mechanism.
Figure 8A:
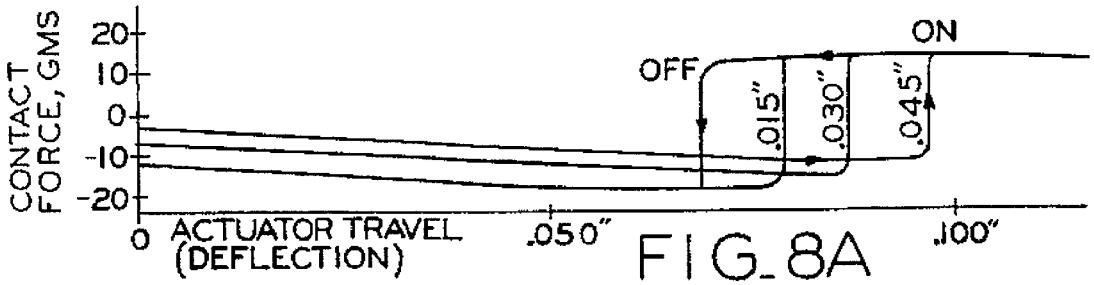
FIG. 8A is a graph of contact force versus actuator travel for the switch mechanism of the present invention.
Figure 8B:
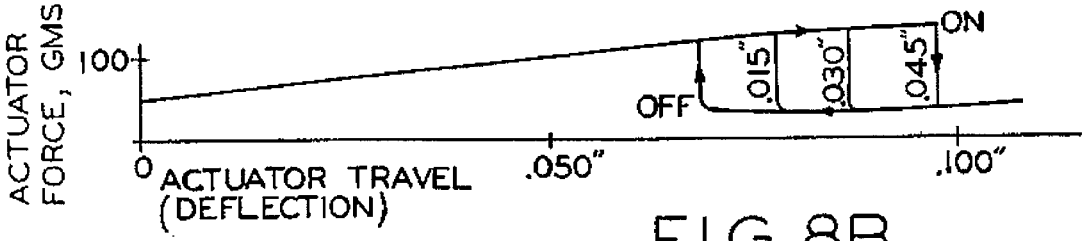
FIG. 8B is a graph of actuator force versus actuator travel for the switch mechanism of the present invention.

Two operating characteristics of a prior art switch mechanism of the type disclosed in U.S. Pat. No. 4,224,488, contact force applied by the movable contact against the fixed contact and force applied by the switch actuator to the toggle blade, are plotted against travel of the switch actuator in FIGS. 7A and 7B of the drawings. The same plots for a switch mechanism of the present invention are shown in FIGS. 8A and 8B. As may be seen in FIG. 7A, the force applied to the fixed contact by the movable contact mounted on the snap spring switch element of the prior art device goes substantially to zero as the actuator approaches the switch point from a direction which will cause the switch to snap to the circuit open position and break the connection (e.g., to turn off a compressor in a refrigerator or freezer). In contrast, as shown in FIG. 8A, the spring switch element 20 of the present invention maintains a high contact force as the actuator 36 approaches the switch point at which the switch element snaps to the circuit open position. Preferably, the contact force drops off no more than 50% as the switch actuator 36 (and toggle blade 50) approach the switch point. However, it has been found that the contact force of the switch element of the present invention drops off no more than 25% to 30% as the switch actuator 36 reaches the switch point.

The spring switch element 20 of the present invention is also operable over a wide range of contact separation settings, permitting significant adjustment in the sensitivity of the switch mechanism 10. As shown in FIG. 3, a gap set screw 74 threadably mounted in the insulated housing portion 14 of the switch mechanism 10 is engageable with the head 46 of the spring switch element 20 behind the movable contact 22 (or with a mounting portion of the movable contact extending through the head) to set the spacing of the movable contact from the fixed contact 24 in the circuit open position. Narrowing the gap increases the sensitivity of the switch mechanism 10 to the detected condition (i.e., the spring switch element 20 will snap from one of the circuit open and circuit closed positions to the other with less travel of the switch actuator 36 and toggle blade 50) and increasing the gap decreases the sensitivity of the switch mechanism. FIGS. 8A and 8B show the location of the "switch on" point for the spring switch element 20 of the specific example described above for gaps of 0.045, 0.030 and 0.015 inches. The switch mechanism "switch off" point is the same without regard to the gap between the contacts. As may be seen the switch mechanism 10 is capable of operating to open and close the circuit for all three spacings.

Figure 9:
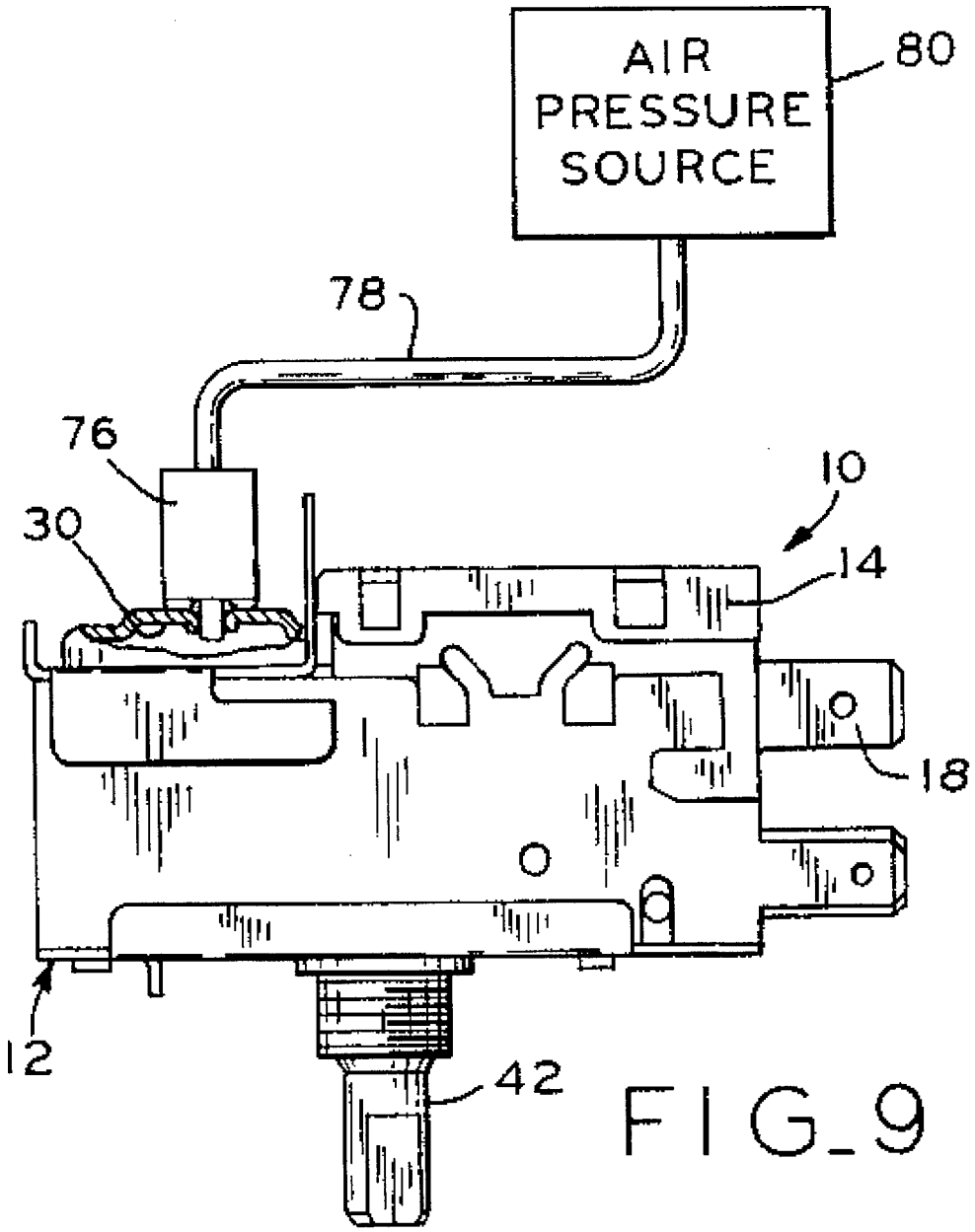
FIG. 9 is a schematic of the switch mechanism illustrating calibration method used for assembling the switch mechanism.

The economies of mass production favor automation of the assembly of the switch mechanism 10 where possible. In the present invention, the bellows 30, actuator link 34, switch actuator 36, adjustment mechanism (e.g., springs 38, 40), spring switch element 20 and other components are all assembled, and the switch mechanism 10 is calibrated before the capillary tube 32 is connected. As illustrated in FIG. 9, air is used to calibrate the switch by sealingly connecting nozzle 76 at the end of an air line 78 extending from a source of air pressure 80 to the opening at the top of the bellows 30 where the capillary tube 32 will be ultimately attached. The air pressure in the bellows 30 is then ramped up and down, above and below the desired pressures at which the spring switch element 20 is to snap between the circuit closed and circuit open positions when the bellows is filled with the operating fluid. The operation of the spring switch element 20 in relation to the pressure in the bellows 30 is monitored and the actuator adjustment mechanism manipulated (i.e., the tension of the springs 38, 40 is adjusted) so that the switching occurs at the desired pressures.

After calibration, the nozzle 76 and air line 78 are removed and an end 82 of the capillary tube 32 is inserted through the open top of the bellows 30 from outside the housing 12 (FIG. 1). The capillary tube 32 is sealingly attached as by soldering to the outside of the housing 12. The air is then evacuated from the capillary tube 32 and bellows 30 and the two are filled with an inert gas such as helium. The joint where the capillary tube 32 has been sealed to the switch housing 12 is monitored for any leakage. The inert gas is then evacuated from the capillary tube 32 and bellows 30 and the operating fluid is injected. Typically, the capillary tube 32 and bellows 30 are filled with operating fluid and evacuated multiple times to be certain to flush out air and other impurities. The end of the capillary tube 32 opposite the bellows 30 is closed, capturing the operating fluid within the capillary tube and bellows.

Accuracy in operation of the switch mechanism 10 in the context of a refrigerator or freezer appliance depends upon the ability of the switch mechanism to activate and deactivate the compressor at very close to the actual desired temperature settings in the appliance. A key feature in the mass production of switch mechanism 10 which all operate accurately is the maintenance of the purity of the operating fluid in the bellows 30 and capillary tube 32. The more pure the operating fluid, the more nearly it will expand and contract according to ideal specifications for the operating fluid. Operating fluid to be charged to the capillary tube 32 and bellows 30 is removed in liquid form from the bottom of the supply container (not shown). Thus, the operating fluid withdrawn is very pure, since any air or other gaseous contaminant in the supply container are left behind. The operating fluid is passed in an evaporator (not shown) through a bath of controlled temperature where the operating fluid is converted to the gaseous form in which it is injected into the capillary tube 32 and bellows 30.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A condition-responsive electric switch mechanism comprising:

a housing including an insulating housing portion;

first and second terminal blades mounted on the insulating housing portion and projecting outwardly therefrom for connection in an electric circuit, the second terminal blade mounting a fixed contact thereon;

condition-responsive means including an actuator movable in response to a detected condition;

a bistable spring switch element carrying a movable contact and being adapted for snap-acting movement between a circuit open position in which the movable contact is spaced from the fixed contact and a circuit closed position in which the movable contact engages the fixed contact, the spring switch element comprising;

a head mounting the movable contact thereon, a pair of arms extending outwardly from the head being formed free of connection to one another at their distal ends opposite the head, the arms being fixed to the first terminal blade only along laterally inner edge margins of their distal ends in a configuration deflected from their relaxed positions thereby to stress the switch element for snapping between said circuit open and circuit closed positions, laterally outer edge margins of the arms at their distal ends being free to flex as the bistable spring switch element snaps between said circuit open and circuit closed positions, and a toggle blade extending outwardly from the head from a location generally between the arms, the toggle blade being operable by engagement with the actuator of said condition-responsive means for motion through a switch point at which the spring switch element snaps between said circuit open position and said circuit closed position.

2. A condition-responsive electric switch mechanism as set forth in claim 1 wherein the distal ends of the arms are fixed to the first terminal blade by a single fastener securing laterally inner edge margins of both distal ends to the second terminal blade and leaving the laterally outer edge margins free to flex.

3. A condition-responsive electric switch mechanism as set forth in claim 2 wherein the arms have finger portions at their distal ends projecting toward each other, the fastener fixing the arms to the first terminal blade engaging the arms at the laterally inner edge margins of the finger portions.

4. A condition-responsive electric switch mechanism as set forth in claim 1 wherein the first terminal blade has two tabs engaging respective arms of the switch element, the tabs being disposed for holding the arms in positions deflected from their relaxed positions by a predetermined amount.

5. A condition-responsive electric switch mechanism as set forth in claim 1 wherein the spring switch element is constructed and arranged to urge the movable contact into engagement with the fixed contact in the circuit closed position with a contact engagement force which does not go substantially to zero as the toggle blade approaches the switch point.

6. A condition-responsive electric switch mechanism as set forth in claim 5 wherein the contact engagement force is reduced by no more than 50% as the toggle blade approaches the switch point.

7. A condition responsive electric switch mechanism as set forth in claim 6 wherein the contact engagement force is reduced by no more than 25% as the toggle blade approaches the switch point.

8. A condition-responsive electric switch mechanism as set forth in claim 1 wherein each arm of the spring switch element is permanently deformed along a bend line out of the plane of the head of the spring switch element.

9. A condition-responsive electric switch mechanism as set forth in claim 8 wherein the arms in their relaxed positions make an angle of between 3° and 6° with the plane of the head.

10. A condition-responsive electric switch mechanism as set forth in claim 9 wherein the arms in their relaxed positions make an angle of between 3.5° and 4.5° with the plane of the head.

11. A condition-responsive electric switch mechanism as set forth in claim 8 wherein the bend line is oblique to the longitudinal centerline of the spring switch element.

12. A condition-responsive electric switch mechanism as set forth in claim 11 wherein each bend line makes an angle of between 30° and 60° with the longitudinal centerline.

13. A condition-responsive electric switch mechanism as set forth in claim 12 wherein each bend line makes an angle of between 39° and 41° with the longitudinal centerline.

14. A condition-responsive electric switch mechanism as set forth in claim 1 further comprising slots defined at least in part between each arm and the corresponding adjacent edge of the toggle blade, the slots tapering toward the head of the spring switch element.

15. A condition-responsive electric switch mechanism as set forth in claim 14 wherein the arms each have a constant width portion, and an increasing width portion extending along the slot where it tapers to the intersection of the arm with the head.

16. A condition-responsive electric switch mechanism as set forth in claim 15 wherein the vertex of the spring switch element in the switch closed position is located generally at the junction of the constant width portion and increasing width portion of each arm.

17. A condition-responsive electric switch mechanism as set forth in claim 14 wherein each arm of the spring switch element is permanently deformed along a bend line out of the plane of the head of the spring switch element, each bend line being oblique to the longitudinal centerline of the spring switch element and passing generally through the longitudinal end of the corresponding slot adjacent the head.

18. A condition-responsive electric switch mechanism as set forth in claim 14 wherein the toggle blade is arranged for engagement with the actuator generally at the distal end of the toggle blade.

19. A condition-responsive electric switch mechanism as set forth in claim 18 wherein the toggle blade has a bump at its distal end disposed for engagement by the actuator.

20. A spring switch element for use in a condition-responsive switch mechanism to selectively open and close an electrical circuit between a first terminal and a second terminal, the spring switch element comprising:

a head adapted for mounting an electrical contact thereon;

a pair of arms extending outwardly from the head, the arms being formed free of connection to one another and spaced apart from one another at their distal ends opposite the head, the arms as fixed to the first terminal being in a configuration deflected from the relaxed position thereby to stress the switch element for snapping between two positions;

each arm being permanently deformed along a bend line out of the plane of the head of the spring switch element;

a toggle blade extending outwardly from the head from a location generally between the arms, the toggle blade being adapted for movement through a switch point at which the spring switch element snaps between said two positions.

21. A spring switch element as set forth in claim 20 wherein the arms in their relaxed positions make an angle of between 3° and 6° with the plane of the head.

22. A spring switch element as set forth in claim 21 wherein the arms in their relaxed positions make an angle of between 3.5° and 4.5° with the plane of the head.

23. A spring switch element as set forth in claim 20 wherein the bend line is oblique to the longitudinal centerline of the spring switch element.

24. A spring switch element as set forth in claim 23 wherein each bend line makes an angle of between 30° and 60° with the longitudinal centerline.

25. A spring switch element as set forth in claim 24 wherein each bend line makes an angle of between 39° and 41° with the longitudinal centerline.

26. A spring switch element as set forth in claim 20 further comprising slots defined at least in part between each arm and the corresponding adjacent edge of the toggle blade, the slots tapering toward the head of the spring switch element.

27. A spring switch element as set forth in claim 26 wherein the arms each have a constant width portion, and an increasing width portion extending along the slot where it tapers to the intersection of the arms with the head.

28. A spring switch element as set forth in claim 27 wherein the vertex of the spring switch element in the switch closed position is located generally at the junction of the constant width portion and increasing width portion of each arms.

29. A spring switch element as set forth in claim 26 wherein each bend line is oblique to the longitudinal centerline of the spring switch element and passing generally through the longitudinal end of the corresponding slot adjacent the head of the spring switch element.

30. A spring switch element as set forth in claim 26 wherein the toggle blade has a bump at its distal end adapted for engagement by the actuator.

31. A condition-responsive electric switch mechanism comprising:

a housing including an insulating housing portion;

first and second terminal blades mounted on the insulating housing portion and projecting outwardly therefrom for connection in an electric circuit, the second terminal blade mounting a fixed contact thereon;

condition-responsive means including an actuator movable in response to a detected condition;

a bistable spring switch element carrying a movable contact and being adapted for snap-acting movement between a circuit open position in which the movable contact is spaced from the fixed contact and a circuit closed position in which the movable contact engages the fixed contact, the spring switch element comprising;

a head mounting the movable contact thereon, a pair of arms extending outwardly from the head being formed free of connection to one another at their distal ends opposite the head, the arms being fixed to the first terminal blade in a configuration deflected from their relaxed positions thereby to stress the switch element for snapping between said circuit open and circuit closed positions, each arm being permanently deformed along a bend line out of the plane of the head of the spring switch element;

and a toggle blade extending outwardly from the head from a location generally between the arms, the toggle blade being operable by engagement with the actuator of said condition-responsive means for motion through a switch point at which the spring switch element snaps between said circuit open position and said circuit closed position.

* * * * *